US006186877B1

(12) United States Patent
Lofaro

(10) Patent No.: US 6,186,877 B1
(45) Date of Patent: Feb. 13, 2001

(54) MULTI-WAFER POLISHING TOOL

(75) Inventor: Michael Francis Lofaro, Marlboro, NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/205,935

(22) Filed: Dec. 4, 1998

(51) Int. Cl.[7] ..... B24B 29/00
(52) U.S. Cl. ..... 451/288; 451/269
(58) Field of Search ..... 451/41, 63, 285, 451/286, 287, 288, 290, 280, 269

(56) References Cited

U.S. PATENT DOCUMENTS

| | | | | |
|---|---|---|---|---|
| 3,951,728 | | 4/1976 | Egashira et al. . | |
| 4,179,852 | * | 12/1979 | Barnett | 51/132 |
| 4,550,239 | | 10/1985 | Uehara et al. . | |
| 4,550,242 | | 10/1985 | Uehara et al. . | |
| 5,240,557 | | 8/1993 | Dyer et al. . | |
| 5,435,772 | | 7/1995 | Yu . | |
| 5,554,065 | | 9/1996 | Clover . | |
| 5,595,522 | | 1/1997 | Simpson et al. . | |
| 5,597,443 | | 1/1997 | Hempel . | |
| 5,645,472 | * | 7/1997 | Nagahashi et al. | 451/261 |
| 5,672,091 | * | 9/1997 | Takahashi et al. | 451/6 |

FOREIGN PATENT DOCUMENTS

| | | |
|---|---|---|
| 09298174 | 11/1997 | (JP) . |
| 09300209 | 11/1997 | (JP) . |

* cited by examiner

*Primary Examiner*—Timothy V. Eley
*Assistant Examiner*—Dung Van Nguyen
(74) *Attorney, Agent, or Firm*—Daryl K. Neff

(57) ABSTRACT

A wafer polishing tool is disclosed which includes a polishing platen which is rotatable about a central platen axis, and a wafer carrier which supports a wafer for rotational movement to cause a portion of a surface of the wafer to only intermittently contact a polishing surface of the platen while the wafer rotates. The polishing tool may include a plurality of vertically stacked polishing platens which are rotatable about a central platen axis, and a plurality of stacked wafer carriers, wherein each carrier supports a wafer for rotational movement and vertical movement into contact with one of the polishing platens. During polishing, the carrier pack maintains the wafers in uninterrupted contact with the platen over less than entire surfaces of the wafers.

29 Claims, 10 Drawing Sheets

MULTI-WAFER POLISHING TOOL

FIELD OF THE INVENTION

This invention relates to equipment used in fabricating semiconductor devices, and more specifically to equipment for performing chemical mechanical polishing (CMP) of semiconductor wafers.

BACKGROUND OF THE INVENTION

Chemical mechanical polishing (CMP) has become an indispensable step in the fabrication of integrated circuit (IC) devices. In some steps of the fabrication process of ICs, later layers cannot be applied to a semiconductor substrate unless an earlier applied layer presents a planar surface. A CMP process is used to planarize such layers. In a step of the fabrication process, it may be desired to obtain a planar surface on an oxide layer. Alternatively, in a different step in fabricating a semiconductor device, a conformal layer of metal is deposited in blanket manner over a dielectric layer to fill vias therein. Then, by a CMP process, the blanket metal layer is polished down to the surface of the dielectric layer. In such a CMP process, it is important for the removal rates of the metal and dielectric materials to be dissimilar in order that polishing stops at the dielectric so that the metal inside the vias does not become overly "dished", i.e. overly removed below the upper surface of the dielectric layer, nor does the dielectric layer become overly thinned, either of which may lead to failure at a later time.

Conventionally, the chemical composition of the slurry is selected in order to adjust a removal rate according to the composition of a specific layer and features therein to be planarized. Apart from the chemical composition of the slurry provided to the CMP tool, two mechanical parameters play a critical role in determining the removal rate. These are the rotational velocity between the wafer and the polishing pad, and the downforce applied to press the wafer against the polishing pad. An increase in either the rotational velocity or the downforce results in a higher removal rate. Conversely, a decrease in the rotational velocity or the downforce results in a lower removal rate.

Currently available CMP polishers process only one or at most a few wafers at one time. The number of wafers which can be polished at one time is limited because conventional CMP polishers require the entire surface of each wafer to be placed in contact with the polishing pad. At current 200 mm wafer diameters, some existing CMP tools polish at most two wafers concurrently. A very large CMP polisher can polish as many as five 200 mm wafers on a single large disc-shaped polishing pad at one time.

With reference to FIG. 14, CMP is conventionally performed on equipment having a large rotating disc-shaped platen 118 of approximately 60 cm in diameter. A wafer 114 is held face down by a carrier 116 on a pad 119 covering the rotating platen 118. The wafer 114 is positioned between the outer disc perimeter 121 and an inner circle 123 at a set radius R from the center 125. Because the rotational velocity of the platen 118 is higher near the outer perimeter 121 of the platen than at the inner circle 123, the wafer is rotated during polishing in order to reduce position-dependent velocity variations which could result in polishing rate differentials at different locations on the wafer surface. However, despite this practice, a difference in rotational velocity still remains between the outer perimeter of the wafer and points near the wafer center. Consequently, a consistent polishing rate is not achieved between the outer perimeter and the interior surface of the wafer.

Because of this difference in rotational velocity at different wafer locations, it is considered undesirable to perform CMP at rotational velocities greater than 140 rpm. The rotational velocity of the disc platen in conventional CMP polishers is generally kept within a range between 10 and 140 rpm.

At conventional platen rotational velocities of 10 to 140 rpm, a force of at least 5 and up to 9 psi must be applied by a wafer carrier 116 to press the wafer towards the platen 118 ("downforce") in order to perform CMP to attain even a marginal wafer processing rate. The application of a downforce of 5 to 9 psi is not uncommon to achieve desirable process throughput. A known consequence of high downforce at the wafer/platen interface is a tendency for differentials in the removal rates of different composition features to increase. Higher downforce results in increased dishing of metal features within an oxide layer, and ultimately reduced planarity when polishing layers which contain features of different composition or pattern density.

Wafer throughput is one measure of the desirability of a CMP tool. There are other measures too. Optimally, CMP tools should be inexpensive to own and operate, occupy little space in a semiconductor foundry, polish to adequate and consistent local planarity, as well as global uniformity, and provide high and consistent throughput.

Existing CMP polishers are larger and more expensive than necessary and provide much lower throughput than that which is made possible by the multi-level polishing tool of the present invention disclosed in the following.

It is therefore an object of the present invention to provide a CMP polisher which provides greater throughput than existing CMP polishers.

A further object of the present invention is to provide a CMP polisher which is smaller than existing CMP polishers.

Another object of the present invention is to provide a CMP polisher which is less expensive to own and operate than existing CMP polishers.

Still another object of the present invention is to provide a CMP polisher which processes wafers in a consistent, quality manner.

Another object of the present invention is to provide a CMP polisher which polishes to superior planarity than that provided by existing CMP polishers.

An additional object of the present invention is to provide a fully integrated CMP polisher which performs in-situ post measurements and endpoint detection as well as wafer clean and dry operations.

SUMMARY OF THE INVENTION

These and other objects of the invention are provided by the wafer polishing tool of the present invention. In a first aspect of the invention, the wafer polishing tool includes a polishing platen which is rotatable about a central platen axis, and a wafer carrier which supports a wafer for rotational movement to cause a portion of a surface of the wafer to only intermittently contact a polishing surface of the platen while the wafer rotates.

According to a second aspect of the invention, a wafer polishing tool is provided which includes a polishing platen which is rotatable about a central platen axis, and a wafer carrier which supports a wafer for rotational movement and in uninterrupted contact with the platen over less than the entire surface of the wafer.

According to another aspect of the invention, a wafer polishing tool is provided which includes a plurality of vertically stacked polishing platens which are rotatable about a central platen axis, and a plurality of stacked wafer carriers, wherein each carrier supports a wafer for rotational movement and vertical movement into contact with one of the polishing platens.

According to another aspect of the invention, a wafer polishing tool includes a plurality of vertically stacked polishing platens which are rotatable about a central platen axis, and a wafer carrier pack which imparts rotational motion to a plurality of wafers, wherein the carrier pack maintains the wafers in uninterrupted contact with the platen over less than entire surfaces of the wafers.

Further preferred embodiments of the invention are disclosed herein.

DETAILED DESCRIPTION OF THE PREFERRED EMBODIMENTS

Figure 1:
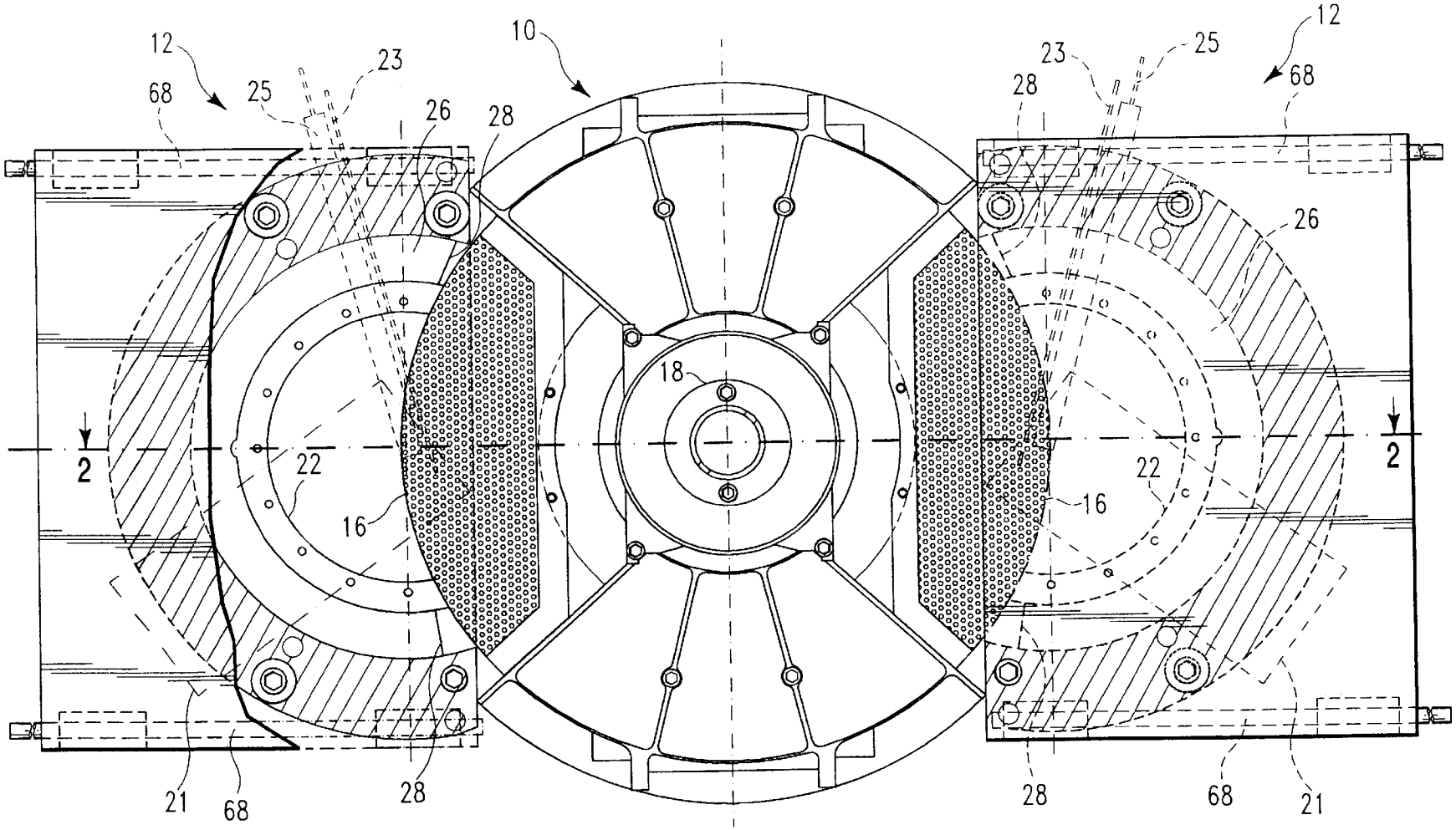
FIG. 1 is a top view of the wafer polishing tool of the present invention showing a platen assembly 10 which is flanked by left and right wafer carrier packs 12.

FIG. 1 is a top view of the wafer polishing tool of the present invention showing a platen assembly 10 which is flanked by left and right wafer carrier packs 12. With reference to a side view thereof in FIG. 2, the platen assembly 10 includes a plurality of polishing platens 14 to the underside of each a polishing pad 16 is attached. Each polishing platen is a hard flat disc having a central opening which engages a central driveshaft 18 of platen assembly 10. A platen 14 is held at a fixable vertical spacing relative to other platens 14 by one or more spacers 20 which fit over the central shaft 18. Platens are preferably substantially rigid and constructed with sufficient mass relative to shaft 18 and spacer (20) to provide rotational inertia for stabilizing rotational motion. A stable system which is capable of rotating the platens at speeds at several hundred to a few thousand revolutions per minute with good inertial characteristics is all that is required. One such rotational system that has been studied in the development of this invention is the Model No. 3380 multi-disk direct access storage device (DASD) drive manufactured by IBM.

Figure 2:
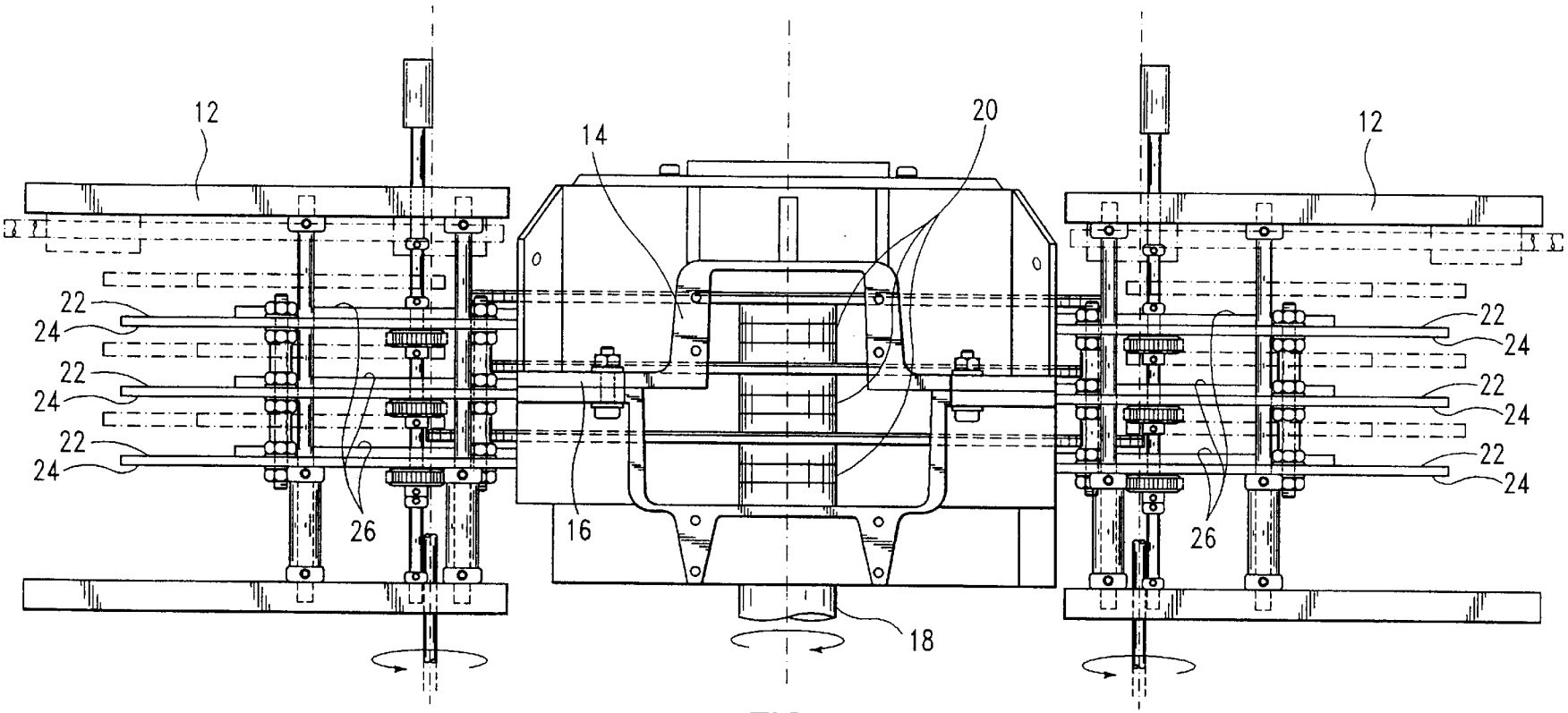
FIG. 2 is a side view of the wafer polishing tool of the present invention.

With reference to FIG. 2, wafer carrier packs 12 each include a plurality of wafer carriers 22. Each wafer carrier 22 includes a base 24 which supports the wafer and has internal components to be described below which cause or permit the wafer to rotate. Each wafer carrier 22 includes a ring 26 which encloses the outer perimeter of a wafer over a majority of the wafer circumference, in order to hold the wafer in position notwithstanding the rotation of the wafer and the platen 14. Ends 28 of rings 26, as shown in FIG. 1, are preferably located at positions slightly to the same side of the center of the wafer bed 38 which is enclosed by the ring 26. Referring to FIG. 1, carrier packs 12 are movable along fixed rails 68 towards and away from platen assembly 10. During polishing, carrier packs 12 oscillate along rails 68 such that the surface of each wafer is polished for substantially the same amount of time regardless of the particular location on the wafer surface.

As further shown in FIG. 1, there are optical endpoint detection mechanisms 21, strobe lights 23, and cleaning brushes 25 located above each wafer of the carrier pack 12. The purpose of the optical measurement and endpoint detection mechanism 21 is to permit in situ endpoint detection while the wafer is engaged in a wafer carrier 22 or even during polishing. Strobe lights 23 fix an image of a moving wafer in position for capture by an imaging lens within optical measurement and endpoint detection mechanism 21. Measurement, detection mechanism 21 can then accurately gauge the stage of the polishing process and provide data for feedback to the operator and/or automated control over the polishing process. Brushes 25 are preferably driven opposite a direction of wafer rotation in order to maximize cleaning effect.

Figure 3:
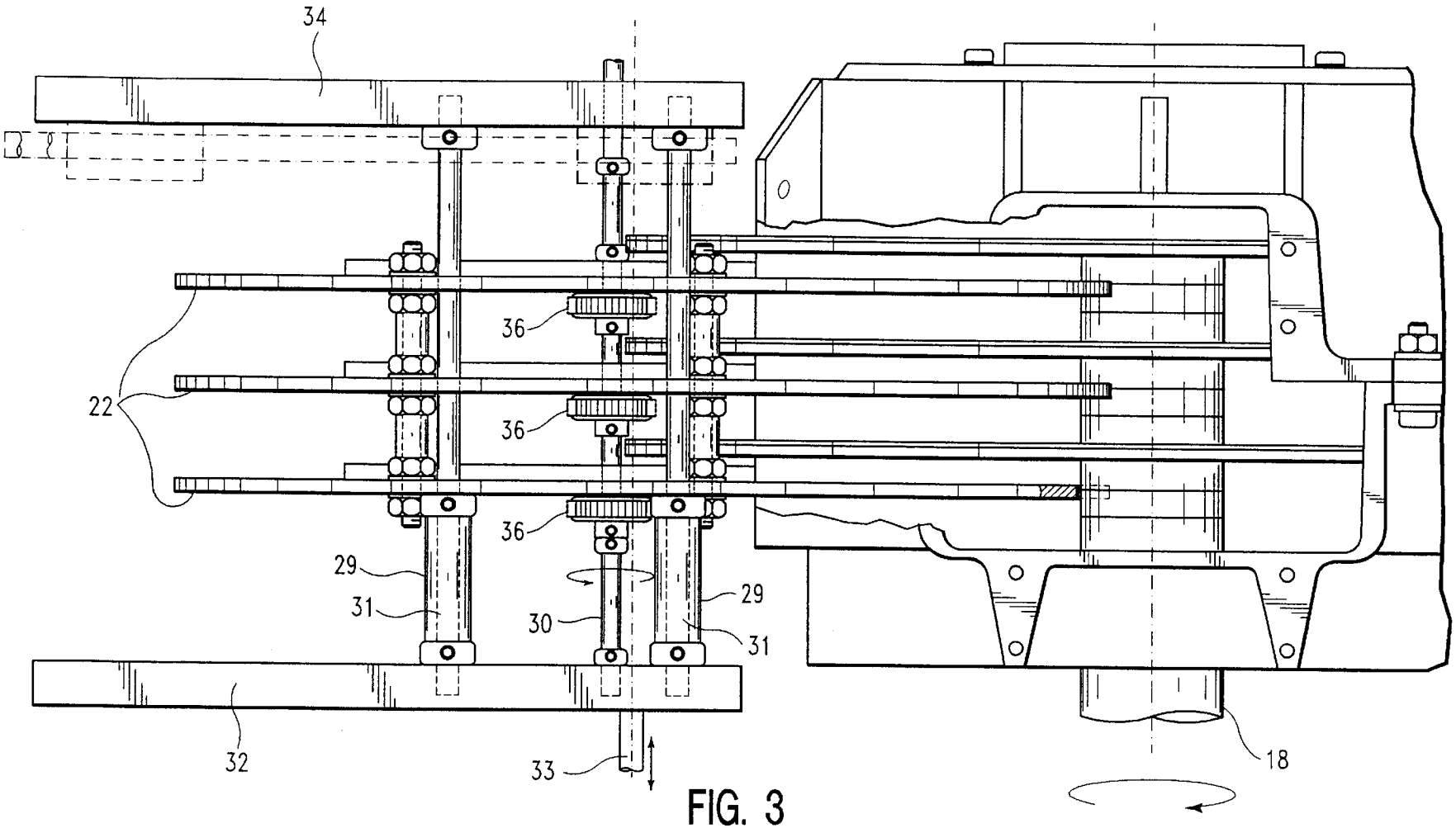
FIG. 3 is a detailed view of a mechanism constructed according to a first embodiment of the invention for applying upward and rotational forces to wafers to bring them into polishing relation with polishing pads 16 of platen assembly 10.

FIG. 3 is a detailed view of a mechanism constructed according to a first embodiment of the invention for applying upward and rotational forces to wafers to bring them into polishing relation with polishing pads 16 of platen assembly 10. Upward movement of wafer carriers 22 is imparted by a vertical lifting force applied at lifting sleeves 29. Lifting sleeves 29 are linked to each other at wafer carrier 22 nearest base 32 and to a lift shaft 33 which, in turn, is vertically moved, preferably by a voice coil motor 88 (FIG. 4B) which allows for precise control over the amount and timing of vertical force applied. Lifting sleeves 29 enclose support shafts 31 and vertically carry the lifting force to higher placed wafer carriers 22 within carrier pack 12.

As further shown in FIG. 3, a carrier assembly 12 is provided with a driveshaft 30 which extends from a base 32 of the carrier assembly 12 through a plurality of wafer carriers 22 to a top 34 of the carrier assembly 12. Driveshaft 30 is provided with a plurality of drive gears 36, each of which is positioned to engage a secondary drive gear 42 coupled to a wafer carrier 22.

Figure 11:
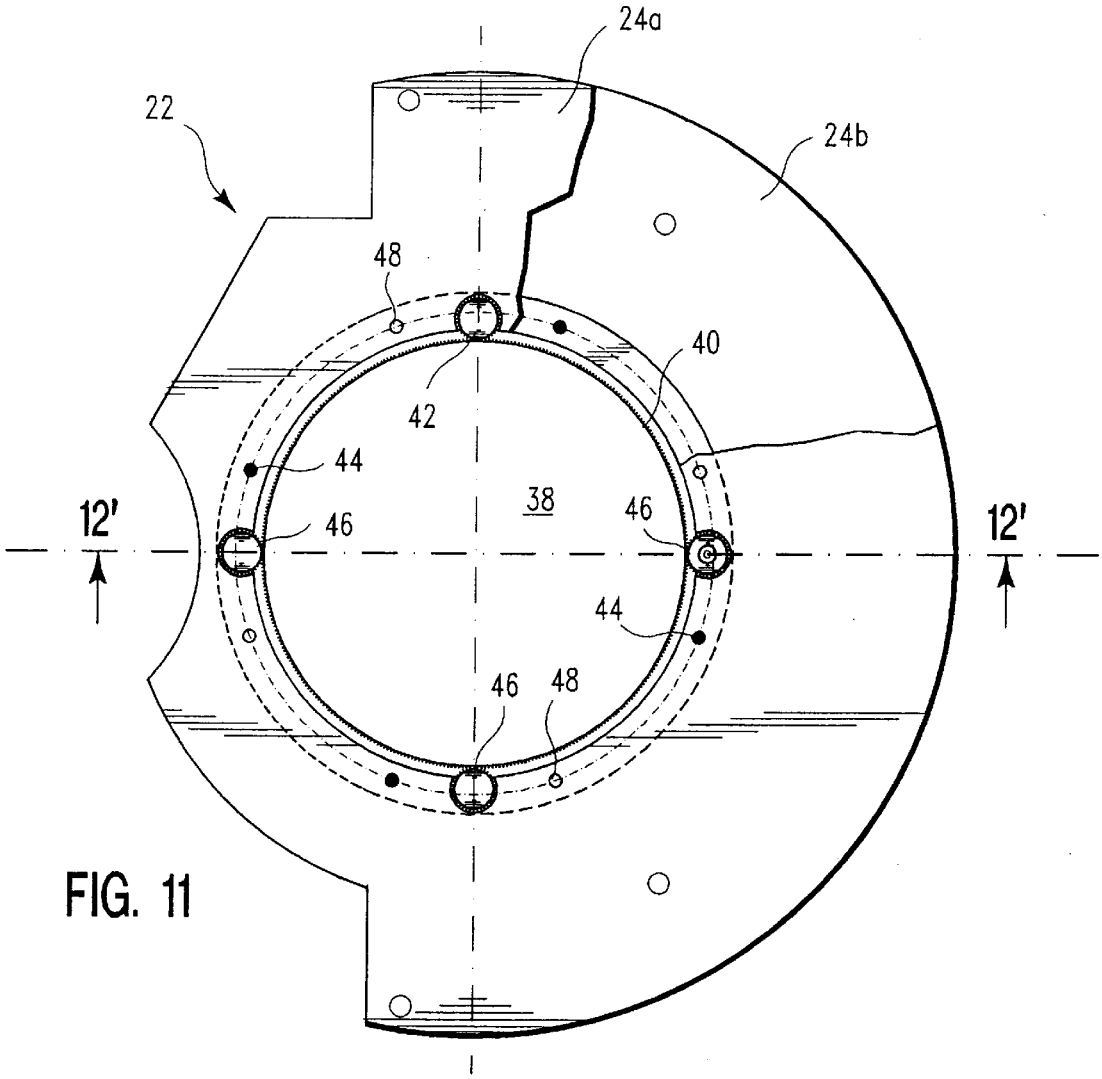
FIG. 11 is a top view of a wafer carrier 22, including top and bottom base members 24*a*, 24*b*, which is used in an embodiment in which a drive gear is used to impart wafer rotation.

FIG. 11 is a top view of a wafer carrier 22, including top and bottom base members 24*a*, 24*b*, wafer bed 38, secondary drive gear 42 and guide gears 46. Wafer carrier 22 is engageable to receive a rotational force through secondary drive gear 42 from drive gear 36 secured to drive shaft 30 of wafer carrier pack 12. Rotation of secondary drive gear 42, in turn, causes gear 40 secured to wafer bed 38 to rotate. Guide gears 46 are provided along a periphery of gear 40 to guide the motion of wafer bed 38 in response to secondary drive gear 42.

Figure 12:
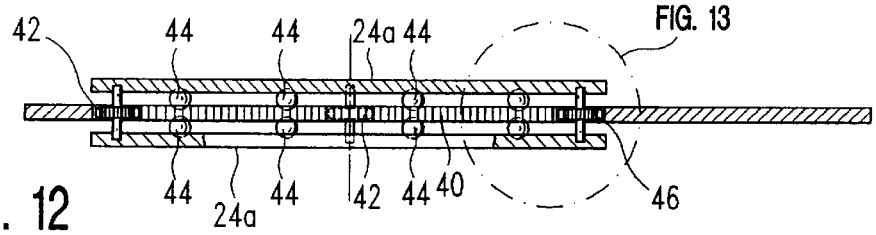
FIG. 12 is a cross-section of the view in FIG. 11 through lines 12'—12'.
Figure 13:
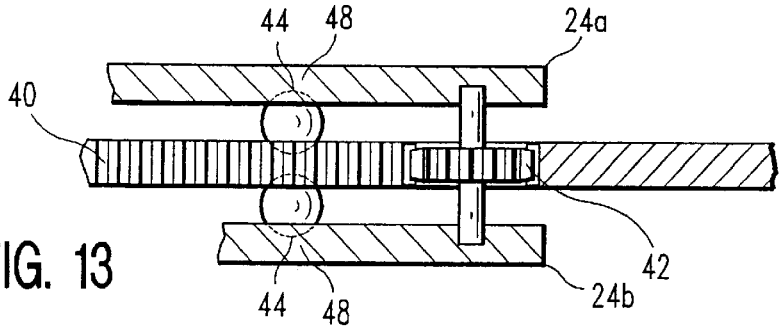
FIG. 13 is a close-up of the view in FIG. 12.
Figure 14:
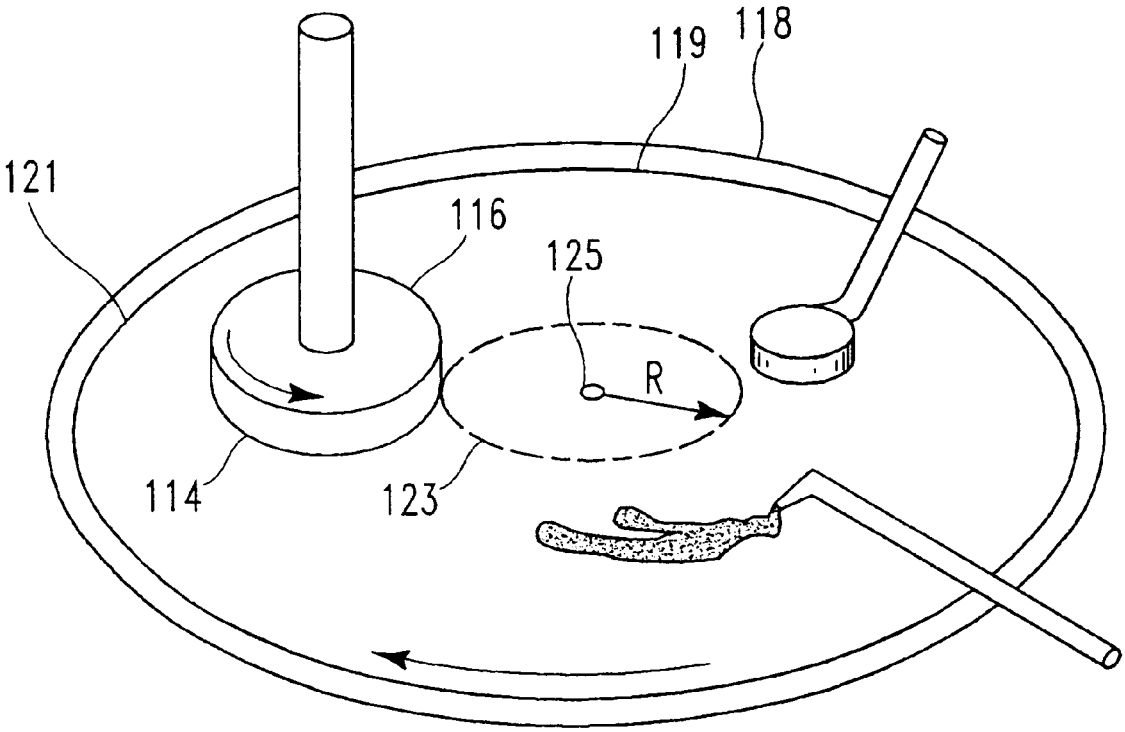
PRIOR ART FIG. 14
FIG. 14 is a perspective drawing of a prior art CMP polisher.

Referring to FIG. 11, wafer bed 38 and gear 40 engaged thereto are held in place laterally by guide gears 46. FIG. 12 is a cross-section of the view in FIG. 11 through lines 12'—12'. FIG. 13 is a close-up of the view in FIG. 12. As shown in FIGS. 12–13, for guiding wafer beds 38, ball bearings 44 are provided, preferably, within fixed concavities 48 within top and bottom base members 24*a*, 24*b* of base 24. Ball bearings 44 ride within a groove (not shown) located within wafer bed 38. Alternatively, a race (not shown) housing a set of ball bearings 44 can be secured within corresponding grooves in top member 24*a* and wafer bed 38, with a second race of ball bearings 44 secured within corresponding grooves in bottom member 24*b* and wafer bed 38.

Figure 4A:
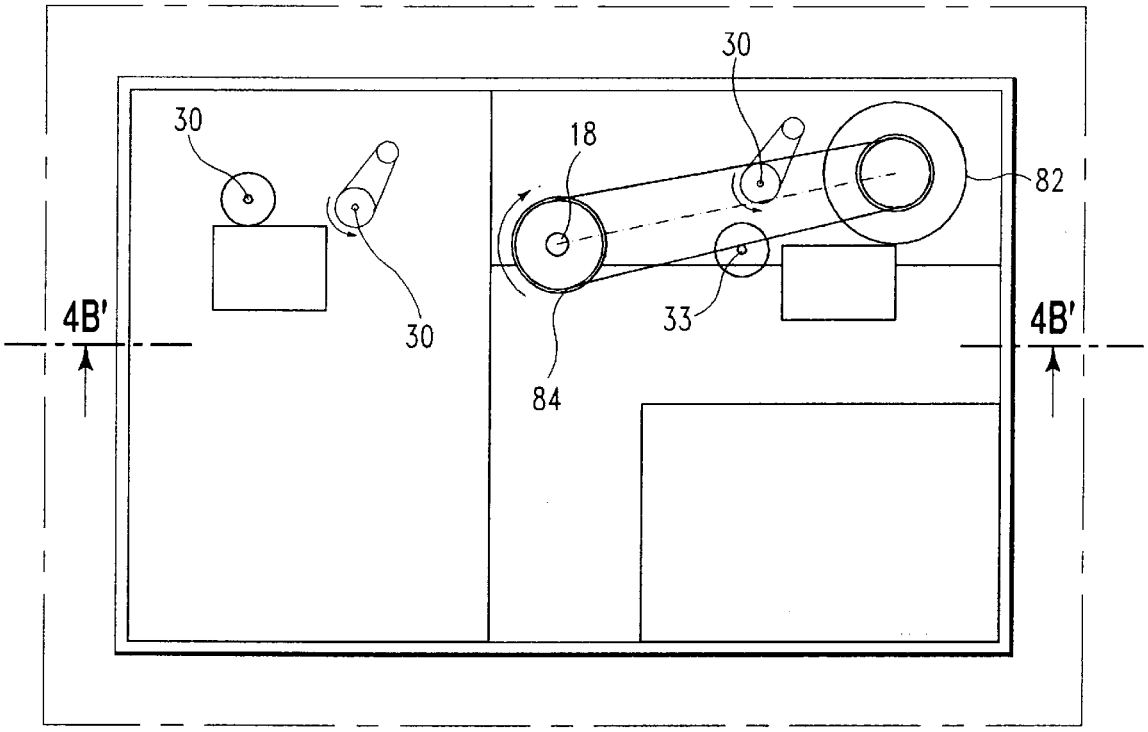
FIGS. 4A and 4B show respective top and side views of a housing 80 containing motors which drive the central platen assembly 10 and left and right carrier packs 12.
Figure 4B:
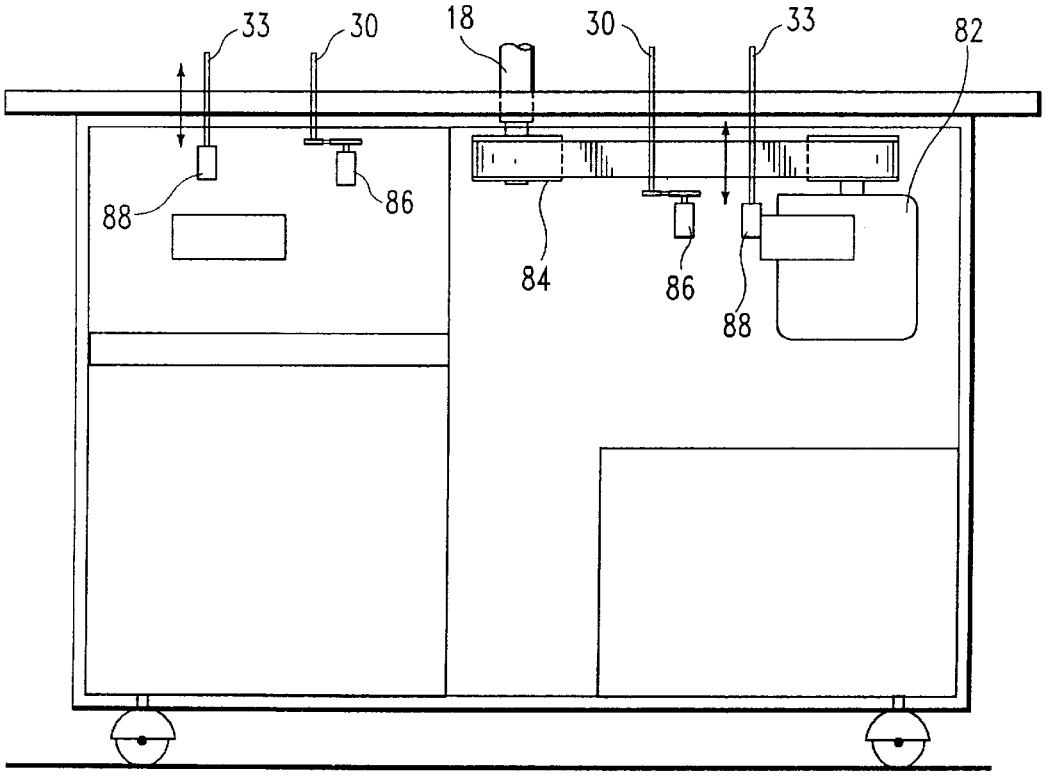

FIGS. 4A and 4B show respective top and side views of a housing 86 containing motors which drive the central platen assembly 10 and left and right carrier packs 12. As shown in FIG. 4A, housing 80 contains a primary motor 82 which, by a belt, drives a pulley 84 which is fastened to platen drive shaft 18. Wafer carrier drive motors 86 which impart rotational force are also shown in approximate positions, as well as voice coil motors 88, which impart a lifting force to wafer carriers 22, as described in the foregoing.

Figure 7:
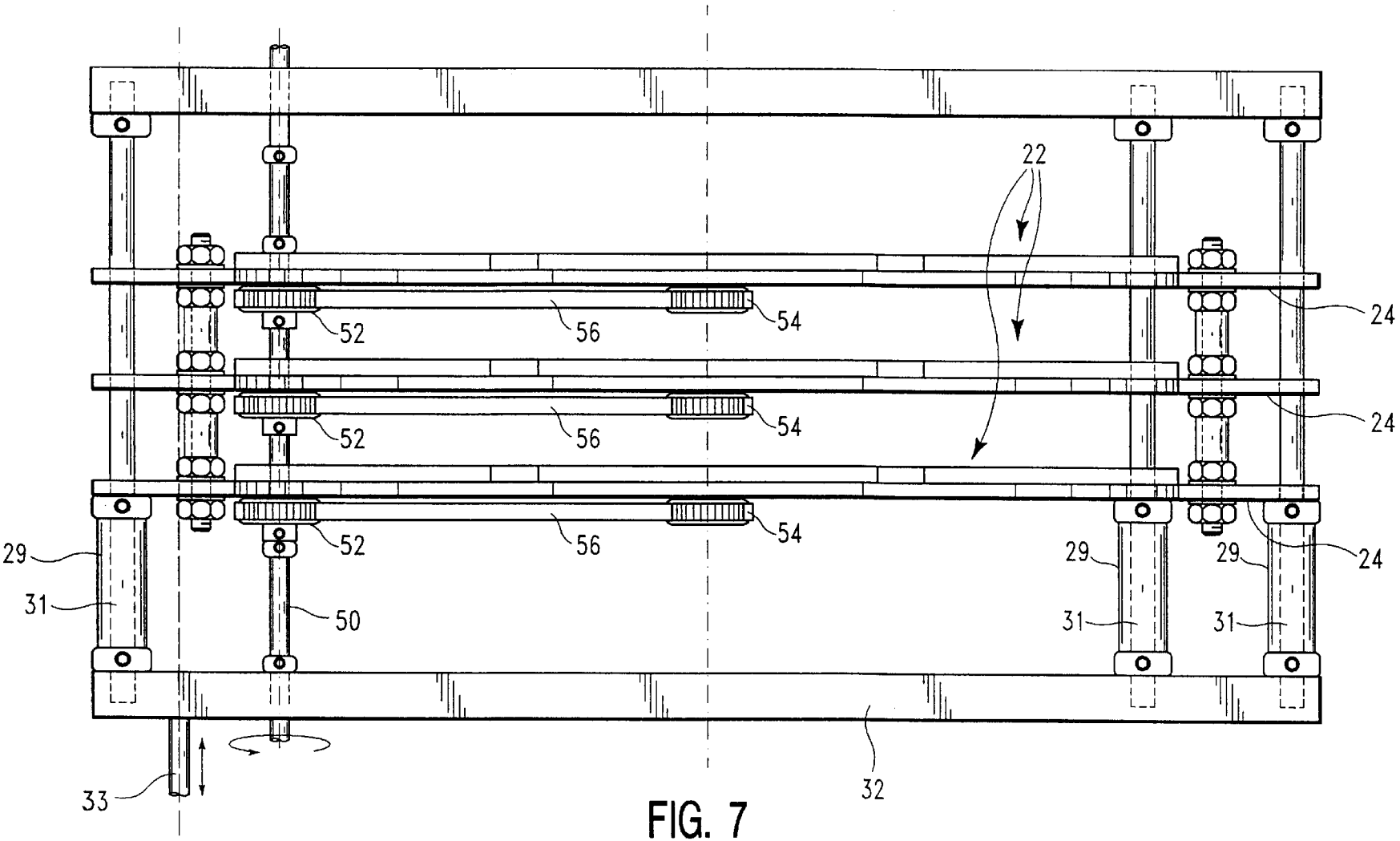
FIG. 7 is a side view of a three-level wafer carrier pack in an embodiment in which a drive shaft and drive pulleys are used to impart wafer rotation.

An alternative to the rotational drive mechanism shown and described in the foregoing with respect to FIGS. 11 through 13 will now be described, with respect to FIGS. 7 through 10. In this embodiment, the vertical lift mechanism is substantially the same as that shown with respect to FIGS. 3 and 11 through 13 and need not be described further. FIG. 7 is a side view of a three-level wafer carrier pack having a drive shaft 31 and drive pulleys 52 secured thereto under the base 24 for each of three wafer carriers 22. Drive pulleys 52 are each linked by a drive belt 56 to a wafer bed pulley 54 secured to a wafer bed 38 of a wafer carrier 22.

Figure 8:
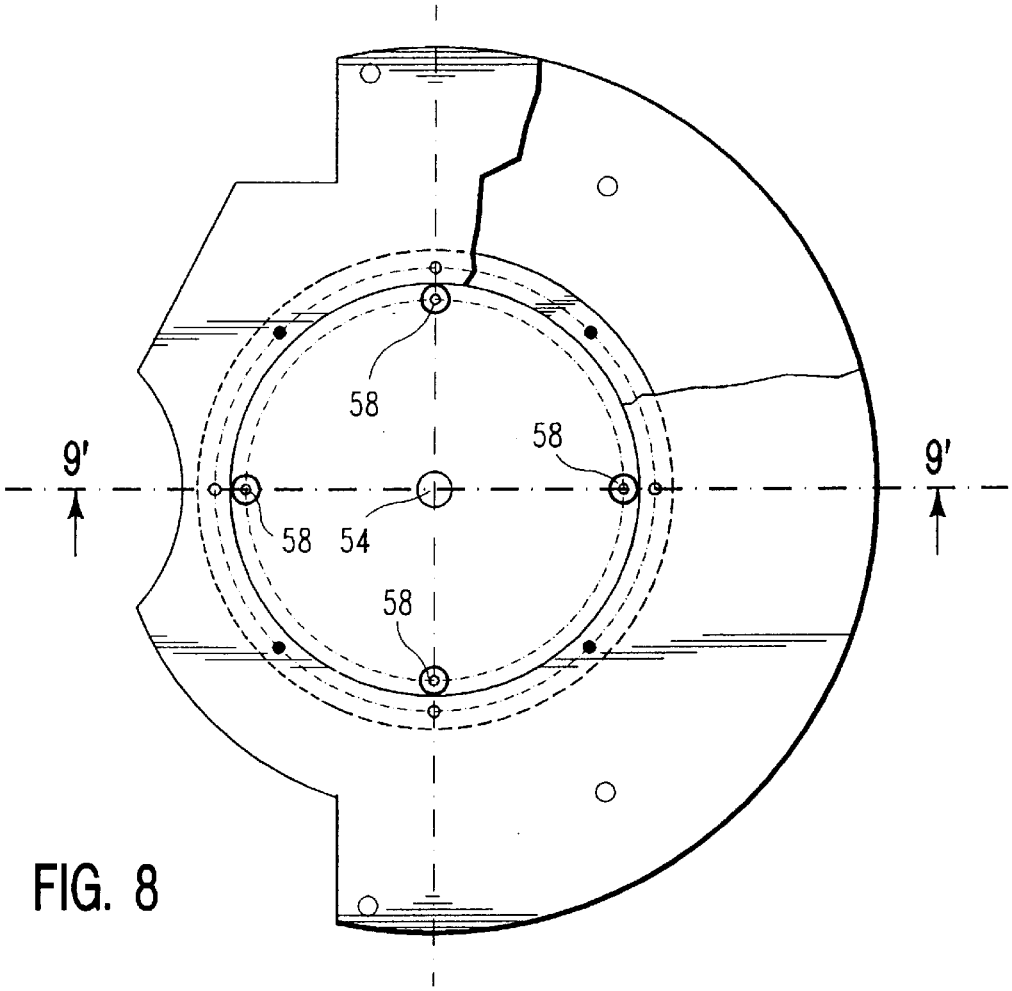
FIG. 8 is a top view of a wafer carrier 22 used in the embodiment shown in FIG. 7.

FIG. 8 is a top view of a wafer carrier 22 for this embodiment of the drive mechanism, including top and bottom base members 24*a*, 24*b*, wafer bed 38 and guide rollers 58. Wafer bed 38 is caused to rotate by a wafer bed pulley 54 secured thereto. Guide rollers 58 provided along a periphery of wafer bed 38 guide the motion of wafer bed 38 in response to rotation of wafer bed pulley 54.

Figure 9:
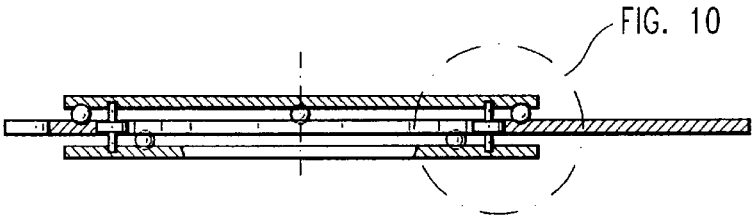
FIG. 9 is a cross-section of the view in FIG. 8 through lines 9'—9'.
Figure 10:
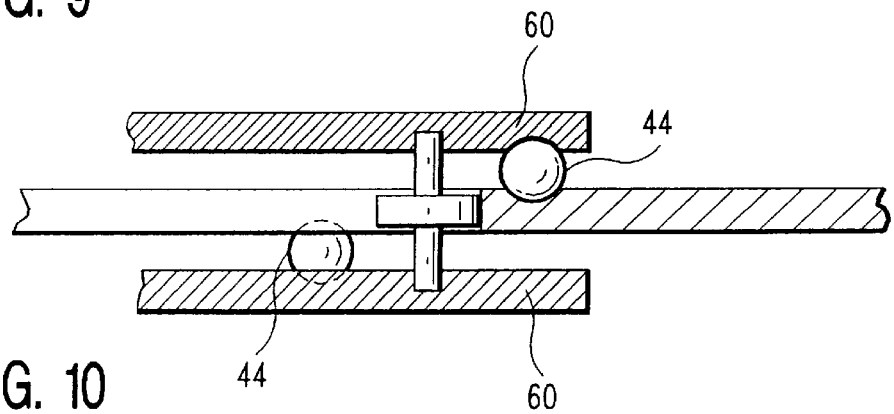
FIG. 10 is a close-up of the view shown in FIG. 9.

FIG. 9 is a cross-section of the view in FIG. 8 through lines 9'—9'. FIG. 10 is a close-up of the view shown in FIG. 9. As in the embodiment described with respect to FIGS. 11–13, ball bearings 44 are provided to guide the rotation of the wafer beds 38. However, ball bearings 44 are preferably provided in concavities 60 located at asymmetric positions within top and bottom base members 24*a*, 24*b* of base 24. In this manner, forces are more evenly distributed over the circumference of wafer bed 38, which may make fabrication of the required hardware simpler and/or if fewer bearings are used, can reduce mass along the periphery of the wafer bed 38 and thereby increase rotational stability.

Figure 5:
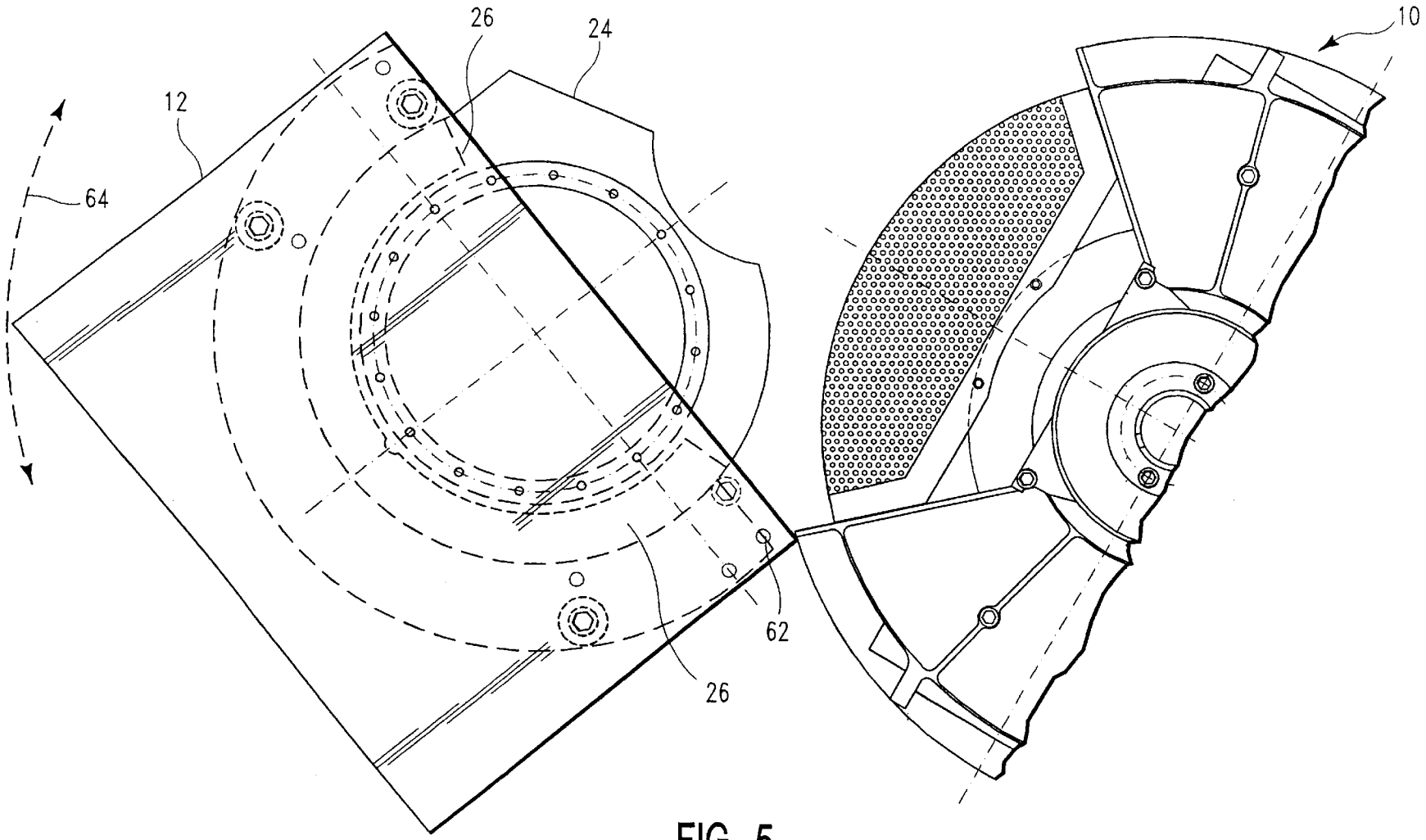
FIG. 5 is a top view of a wafer carrier pack and polishing platen assembly showing a first, pivotable alternative engaging mechanism.
Figure 6:
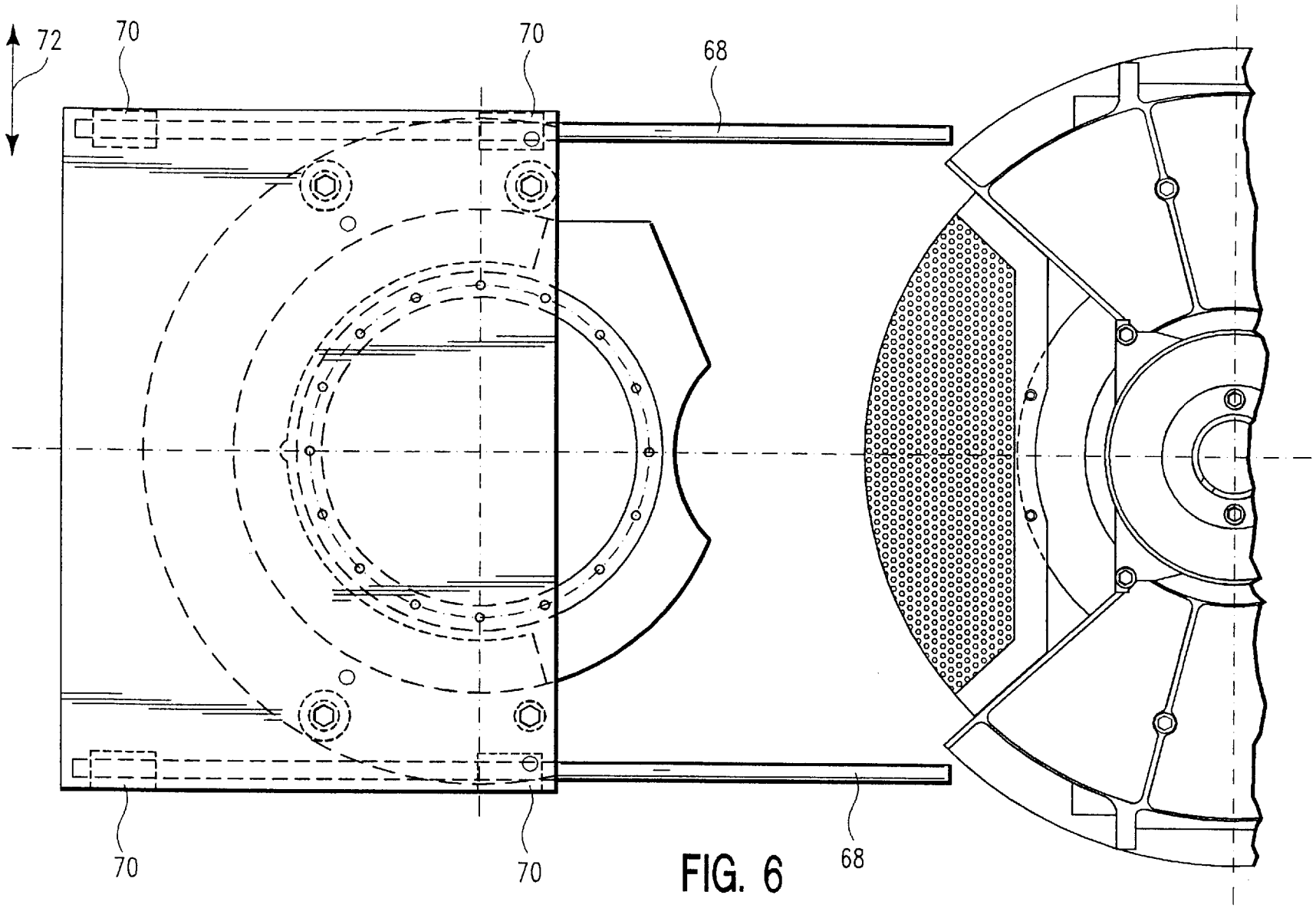
FIG. 6 is a top view of a wafer carrier pack and polishing platen assembly showing a second, slidable, alternative engaging mechanism.

FIGS. 5 and 6 show respective embodiments of engaging mechanisms which bring wafer carrier packs 12 into position with platen assembly 10 so that wafers can be polished. FIG. 5 shows the relationship of carrier pack 12 to platen assembly 10 in an embodiment in which carrier pack 12 pivots with respect to a fixed pin 62 generally along an arc 64 towards and away from platen assembly 10. In this manner, once wafers are loaded into carrier pack 12, the entire carrier pack 12 is pivoted into position for polishing of individual wafers by respective platens 14. During polishing, carrier pack 12 oscillates slightly around its pivot point to provide even polishing of the entire wafer surface, as in the embodiment described in the foregoing with reference to FIG. 1.

FIG. 6 shows the relationship of carrier pack 12 to platen assembly 10 in which carrier pack 12 is movable along fixed rails 68 towards and away from platen assembly 10. In this embodiment, carrier pack 12 includes a plurality of rail guides 70 which maintain carrier pack 12 in a fixed relation along axis 72. Once wafers are loaded into the carrier pack 12 as shown in FIG. 6, the entire carrier pack 12 is moved along rails 68 into position for polishing of individual wafers by respective platens 14.

In operation, the wafer carrier pack 12 is disengaged from platen assembly 10 by movement along rails 68 (FIG. 6) or about pivot shaft 62. Wafers are then loaded onto carriers 22 of the carrier pack 12 by hand or by automated means. A preferred automated loader includes a robot which has multiple pairs of wafer "pencils" (the digits of the robotic hand), each pair of which clutches a wafer so that several wafers are loaded onto the polisher with one sweeping movement of the robotic arm from the wafer cassette to the carriers 22. Alternatively, wafers may be picked up and held by vacuum by vacuum fingers and then deposited by the robot into wafer carriers 22.

After the wafers have been loaded, wafer carrier packs 12 are then slid (FIG. 6) or pivoted (FIG. 5) into and engaged position (FIGS. 1, 2) with respect to platen assembly. Rotational motion is imparted to platens 14 and to wafer beds 38 through respective drive motors 82, 86 and wafer carriers are then lifted into polishing position by vertical drive motors 88 linked to lifting sleeves 29 coupled to wafer carriers 22. By appropriate signals provided to vertical drive motors, which are preferably voice coil motors, the wafer to platen polishing pressure is finely controlled and can be increased, reduced or cycled during polishing through different levels to meet the particular polishing objective. In addition, a feedback signal from a force transducer secured to a wafer carrier can be provided to the voice coil motor to more finely control the vertical force applied thereto.

Because the rotational drive mechanism of the present invention permits wafer to platen rotational speeds which are in the hundreds to thousands of revolutions per minute (rpm) and are much greater than heretofore, the wafer to polishing pressure can be vastly reduced while still preserving desirable removal rates. In this manner, greater planarity and much less dishing are achieved during polishing.

During polishing, a polishing slurry is applied to the wafer or, alternatively, to the underside of polishing pad 16 through a porous (e.g sponge-like) applicator which engages platen assembly 10. Brushes 25 remove abrasive materials from wafers during polishing to reduce scratching and provide better control over the polishing. To provide polishing uniformity across the wafer surface, oscillating motion towards and away from platen assembly 10 is provided in the direction of rails 68 (FIG. 6) or about the pivot shaft 62 (FIG. 5).

While carrier pack 12 is engaged to platen assembly 10 or during polishing, measurement and detection systems 21, with aid of strobe lights 23 provided above the wafer surfaces, provide real-time measurements for monitoring or endpoint detection purposes. Rather than relying on guesswork or samples, an endpoint detection signal is provided directly from the wafer being polished at the time that the wafer polishing is being performed.

While the invention has been described herein in accordance with certain preferred embodiments thereof, those skilled in the art will recognize the many modifications and enhancements which can be made without departing from the true scope and spirit of the invention set forth in the appended claims.

What is claimed is:

1. A wafer polishing tool, comprising:

a polishing platen rotatable about a central platen axis;

a wafer carrier supporting a wafer for rotational movement to cause a portion of a surface of said wafer to only intermittently contact a polishing surface of said platen while said wafer rotates during polishing, while a center of said wafer at least intermittently contacts said polishing surface during said polishing, said wafer carrier having a center-driven wafer bed, wherein said center-driven wafer bed is rotated by a belt-drive mechanism coupled to transmit rotational force from a motor onto a pulley secured to said wafer bed.

2. A wafer polishing tool, comprising:

a polishing platen rotatable about a central platen axis;

a wafer carrier supporting a wafer for rotational movement to cause a portion of a surface of said wafer to only intermittently contact a polishing surface of said platen while said wafer rotates during polishing, while a center of said wafer at least intermittently contacts said polishing surface during said polishing, wherein said wafer carrier rotates said wafer from an edge thereof.

3. The wafer polishing tool of claim 2 wherein said wafer carrier includes a wafer bed gear having an outer perimeter located approximately at an edge of said wafer.

4. The wafer polishing tool of claim 3 wherein said wafer carrier further includes a drive gear positioned near said wafer edge in drivable relation to said wafer bed gear.

5. A wafer polishing tool, comprising:

a polishing platen rotatable about a central platen axis; and a wafer carrier supporting a wafer for rotational movement and in uninterrupted contact with said platen over less than an entire surface of said wafer while said wafer rotates during polishing while a center of said wafer at least intermittently contacts said polishing surface during said polishing, said wafer carrier having a center-driven wafer bed, wherein said center-driven wafer bed is rotated by a belt-drive mechanism coupled to transmit rotational force from a motor onto a pulley secured to said wafer bed.

6. A wafer polishing tool, comprising:

a polishing platen rotatable about a central platen axis; and a wafer carrier supporting a wafer for rotational movement and in uninterrupted contact with said platen over less than an entire surface of said wafer while said wafer rotates during polishing while a center of said wafer at least intermittently contacts said polishing surface during said polishing, wherein said wafer carrier rotates said wafer from an edge thereof.

7. The wafer polishing tool of claim 6 wherein said wafer carrier includes a wafer bed gear having an outer perimeter located approximately at an edge of said wafer.

8. The wafer polishing tool of claim 7 wherein said wafer carrier further includes a drive gear positioned near said wafer edge in drivable relation to said wafer bed gear.

9. A wafer polishing tool, comprising:

a polishing platen rotatable about a central platen axis; and a wafer carrier supporting a wafer for rotational movement and in uninterrupted contact with said platen over less than an entire surface of said wafer while said wafer rotates during polishing while a center of said wafer at least intermittently contacts said polishing surface during said polishing, wherein said wafer carrier further comprises a pivotable frame member and a selectively engageable frame member, said pivotable and said selectively engageable frame members permitting said wafer carrier to pivot between a platen engaged position and a platen disengaged position and wherein said wafer carrier imparts oscillating motion to said wafer in a direction about said pivotable frame member.

10. A wafer polishing tool, comprising:

a plurality of vertically stacked polishing platens rotatable about a central platen axis;

a plurality of vertically stacked wafer carriers, each said carrier supporting a wafer for rotational movement and vertical movement into contact with one of said polishing platens.

11. A wafer polishing tool, comprising:

a plurality of vertically stacked polishing platens rotatable about a central platen axis; and a wafer carrier pack imparting rotational motion to a plurality of wafers, said carrier pack maintaining said wafers in uninterrupted contact with said platen over less than entire surfaces of said wafers.

12. The wafer polishing tool of claim 11 wherein said wafer carrier pack further comprises a plurality of wafer carriers each supporting a wafer in a respective parallel plane and at least a pair of rails for permitting movement between a platen engaged position and a platen disengaged position.

13. The wafer polishing tool of claim 12 wherein said wafer carrier pack imparts oscillating motion to said wafers along a direction of towards and away from said polishing platens.

14. The wafer polishing tool of claim 11 wherein said wafer carriers are fastened to each other at points outside the perimeter of said wafers.

15. The wafer polishing tool of claim 11 further comprising a voice coil motor coupled to said wafer carrier pack to apply a vertical force thereto.

16. The wafer polishing tool of claim 11 further comprising a force transducer located on said wafer carrier pack to provide a feedback input to said voice coil motor.

17. The wafer polishing tool of claim 11 wherein said wafer carrier pack further comprises a pivotable frame member and a selectively engageable frame member, said pivotable and said selectively engageable frame members permitting said wafer carrier pack to pivot between a platen engaged position and a platen disengaged position.

18. The wafer polishing tool of claim 17 wherein said carrier pack imparts oscillating motion to said wafers in a direction about said pivotable frame member.

19. The wafer polishing tool of claim 11 wherein said polishing tool further comprises a brush positioned to contact a portion of said polished surface of said wafer while another portion of said surface contacts said platen.

20. The wafer polishing tool of claim 11 wherein said wafer carriers support said wafers in face up orientation and polishing pad surfaces of said rotatable platens face down towards said face up wafer surfaces.

21. The wafer polishing tool of claim 20 further comprising a porous material slurry applicator for maintaining in contact with a polishing surface of said platen during a polishing cycle.

22. The wafer polishing tool of claim 20 wherein said polishing tool further comprises a brush positioned to contact said face up wafer surface during polishing.

23. The wafer polishing tool of claim 11 wherein said wafer carriers support said wafers in face down orientation and polishing pad surfaces of said rotatable platens face up towards said face down wafer surfaces.

24. The wafer polishing tool of claim 11 further comprising a process monitor positioned to obtain process monitoring information from said polished surface of said wafer while said wafer carrier pack is engaged in said platen assembly.

25. The wafer polishing tool of claim 11 wherein said wafer carrier pack includes a plurality of center-driven wafer carriers.

26. The wafer polishing tool of claim 1 wherein said center-driven wafer carriers include a belt-drive mechanism coupled to transmit rotational force from a motor onto a pulley secured to a wafer bed.

27. The wafer polishing tool of claim 11 wherein said wafer carrier pack includes a plurality of edge-driven wafer carriers.

28. The wafer polishing tool of claim 27 wherein each said edge-driven wafer carrier includes a wafer bed gear having an outer perimeter located approximately at an edge of said wafer.

29. The wafer polishing tool of claim 28 wherein said wafer carrier pack further includes a drive gear positioned near said wafer edge in drivable relation to said wafer bed gear.

* * * * *